US008800333B2

(12) United States Patent
Rao et al.

(10) Patent No.: US 8,800,333 B2
(45) Date of Patent: Aug. 12, 2014

(54) KEY AND LOCK CYLINDER COMBINATION

(75) Inventors: Ajeya S. Rao, Mangalore (IN); Frederick M. Hensley, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 142 days.

(21) Appl. No.: 13/454,772

(22) Filed: Apr. 24, 2012

(65) Prior Publication Data

US 2012/0266638 A1 Oct. 25, 2012

Related U.S. Application Data

(60) Provisional application No. 61/478,919, filed on Apr. 25, 2011.

(51) Int. Cl.
*E05B 27/00* (2006.01)

(52) U.S. Cl.
USPC ..... 70/409; 70/490; 70/493; 70/495; 70/405; 70/407

(58) Field of Classification Search
USPC ..... 70/490–495, 405–409
See application file for complete search history.

(56) References Cited

U.S. PATENT DOCUMENTS

| | | | | |
|---|---|---|---|---|
| 4,638,651 | A | 1/1987 | Surko, Jr. | |
| 5,640,865 | A | 6/1997 | Widen | |
| 5,715,717 | A | 2/1998 | Widen | |
| 5,809,816 | A | 9/1998 | Widen | |
| 5,819,566 | A | 10/1998 | Eden, Jr. | |
| 5,845,525 | A | 12/1998 | Widen | |
| 6,105,404 | A | 8/2000 | Field et al. | |
| 6,851,292 | B2 | 2/2005 | Kruhn | |
| 7,159,424 | B2 | 1/2007 | Widen | |
| 7,370,502 | B2 | 5/2008 | Widen | |
| 7,665,337 | B1 | 2/2010 | Widen | |
| 8,156,777 | B1 | 4/2012 | Widen | |
| 8,205,473 | B2 * | 6/2012 | Widen | 70/409 |
| 8,210,009 | B2 * | 7/2012 | Widen | 70/409 |
| 8,230,708 | B2 * | 7/2012 | Widen | 70/409 |
| 8,539,803 | B2 * | 9/2013 | Widen | 70/490 |
| 2003/0164012 | A1 | 9/2003 | Kruhn | |
| 2006/0075795 | A1 | 4/2006 | Lurie | |
| 2011/0056258 | A1 | 3/2011 | Widen | |
| 2011/0179840 | A1 * | 7/2011 | Widen | 70/406 |
| 2012/0073340 | A1 * | 3/2012 | Widen | 70/495 |
| 2012/0240645 | A1 * | 9/2012 | Mathachan | 70/491 |

FOREIGN PATENT DOCUMENTS

| | | | |
|---|---|---|---|
| EP | 1 217 151 | B1 | 1/2001 |
| WO | WO 01/96696 | A1 | 12/2001 |

OTHER PUBLICATIONS

International Search Report and Written Opinion issued in International Patent Application No. PCT/US2012/034808, mailed Jul. 9, 2012, 9 pages.

* cited by examiner

*Primary Examiner* — Suzanne Barrett
(74) *Attorney, Agent, or Firm* — Krieg DeVault LLP

(57) ABSTRACT

Some embodiments disclosed include keys, lock cylinders, and key and lock cylinder combinations. The keys include a bow and a blade extending from the bow, where the blade includes at least one undercut groove in a lateral side thereof that receives at least one projection defining a keyway passage of a lock cylinder in which the key is positioned.

35 Claims, 5 Drawing Sheets

KEY AND LOCK CYLINDER COMBINATION

CROSS-REFERENCE TO RELATED APPLICATION

The present application claims the benefit of the filing date of Provisional Application No. 61/478,919 filed on Apr. 25, 2011, which is incorporated herein by reference.

FIELD OF THE INVENTION

The present invention relates to a lock cylinder and key combination, and more particularly, the present invention relates to a lock cylinder that is mounted in a door and that includes a housing and a plug.

BACKGROUND

Generally, lock assemblies include a housing and a plug that form a lock cylinder and that define respective pin chambers to receive pin pairs. The pin pairs include outer pins substantially disposed within the housing, and inner pins disposed within the plug. Springs are often used to bias the pin pairs toward a key passageway defined in the plug. More specifically, the springs are engaged with the outer pins, which in turn engage the inner pins and force the inner pins into the key passageway. In the absence of a correct or proper key, the outer pins are partially disposed in the plug and block rotation of the plug within the housing.

The plug is rotatable relative to the housing in most conventional lock assemblies. A shear line is defined where the plug and the housing come together. When a proper or appropriate key is inserted into the key passageway, the inner pins are moved and, as a result, move the respective outer pins. The ends where the inner pins and the outer pins contact each other are aligned with the shear line upon insertion of the proper key, and allow the plug to be turned to a locked or unlocked position. In other words, the proper key will move the inner and outer pins such that the outer pins are disposed completely in the housing, and the inner pins are disposed completely in the plug.

SUMMARY

Embodiments disclosed herein include unique apparatus and assemblies involving keys, lock cylinders, and key and lock cylinder combinations. Other embodiments include unique methods, systems, devices, and apparatus involving keys, lock cylinders, and keying systems. The keys include a bow and a blade extending from the bow, where the blade includes at least one undercut groove in a lateral side thereof that receives at least one projection defining a keyway passage of a lock cylinder in which the key is positioned. Further embodiments, forms, features, aspects, benefits, and advantages of the present application shall become apparent from the description and figures provided herewith.

Other aspects of the invention will become apparent by consideration of the detailed description and accompanying drawings.

DETAILED DESCRIPTION

Figure 1:
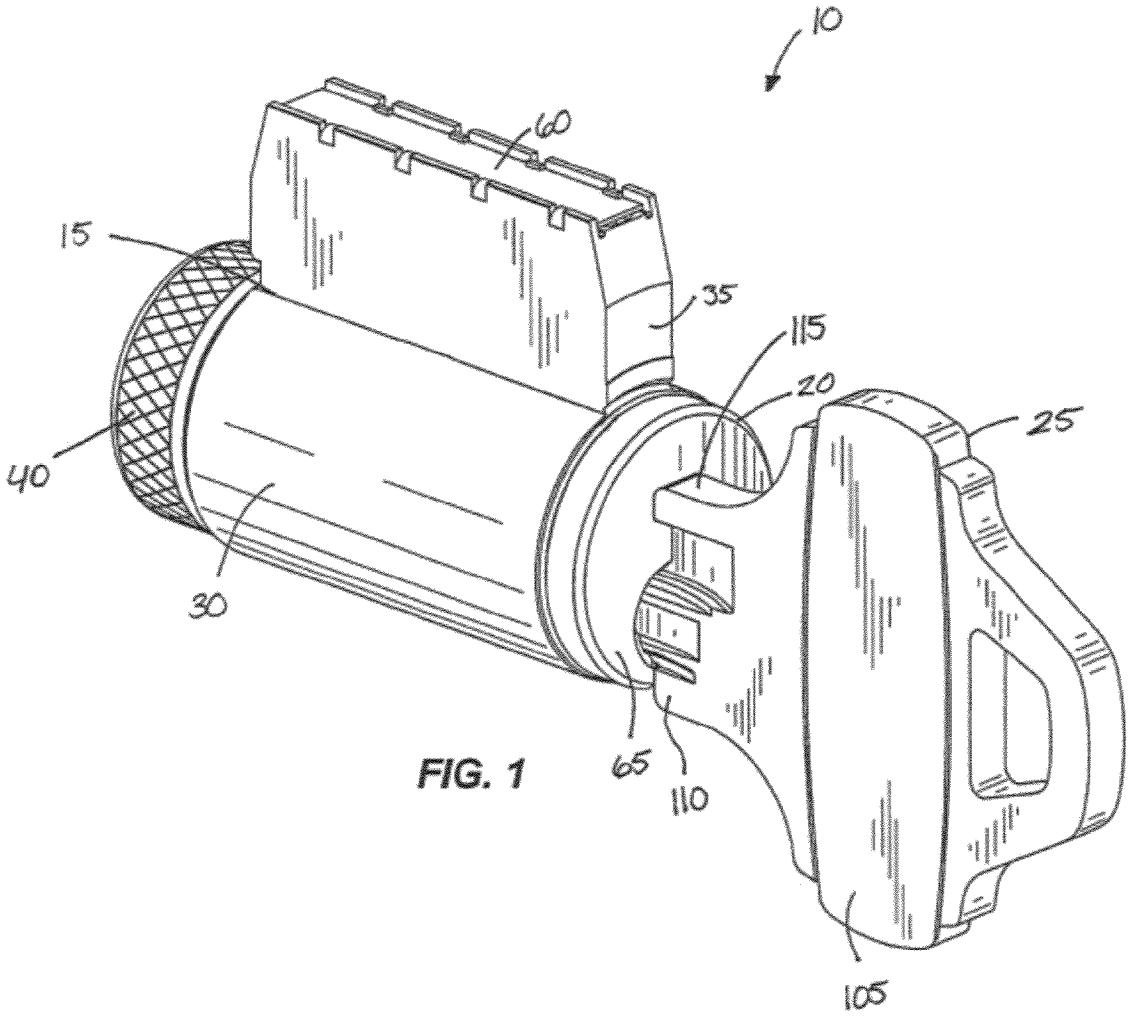
FIG. 1 is a perspective view of a key and lock cylinder combination including a housing, a plug, and a key.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the illustrated embodiments, and any further applications of the principles of the invention as described herein as would normally occur to one skilled in the art to which the invention relates are contemplated.

FIG. 1 shows a lock cylinder 10 for use with structures (e.g., doors, access panels, portable locks, etc.) that may be locked and unlocked. Hereinafter, the term "door" shall be used to represent all such lockable structures and shall not be construed to limit the invention's application solely to doors. The lock cylinder 10 includes a housing 15 and a plug 20 that is selectively rotatable within the housing 15 using a key 25.

Figure 2:
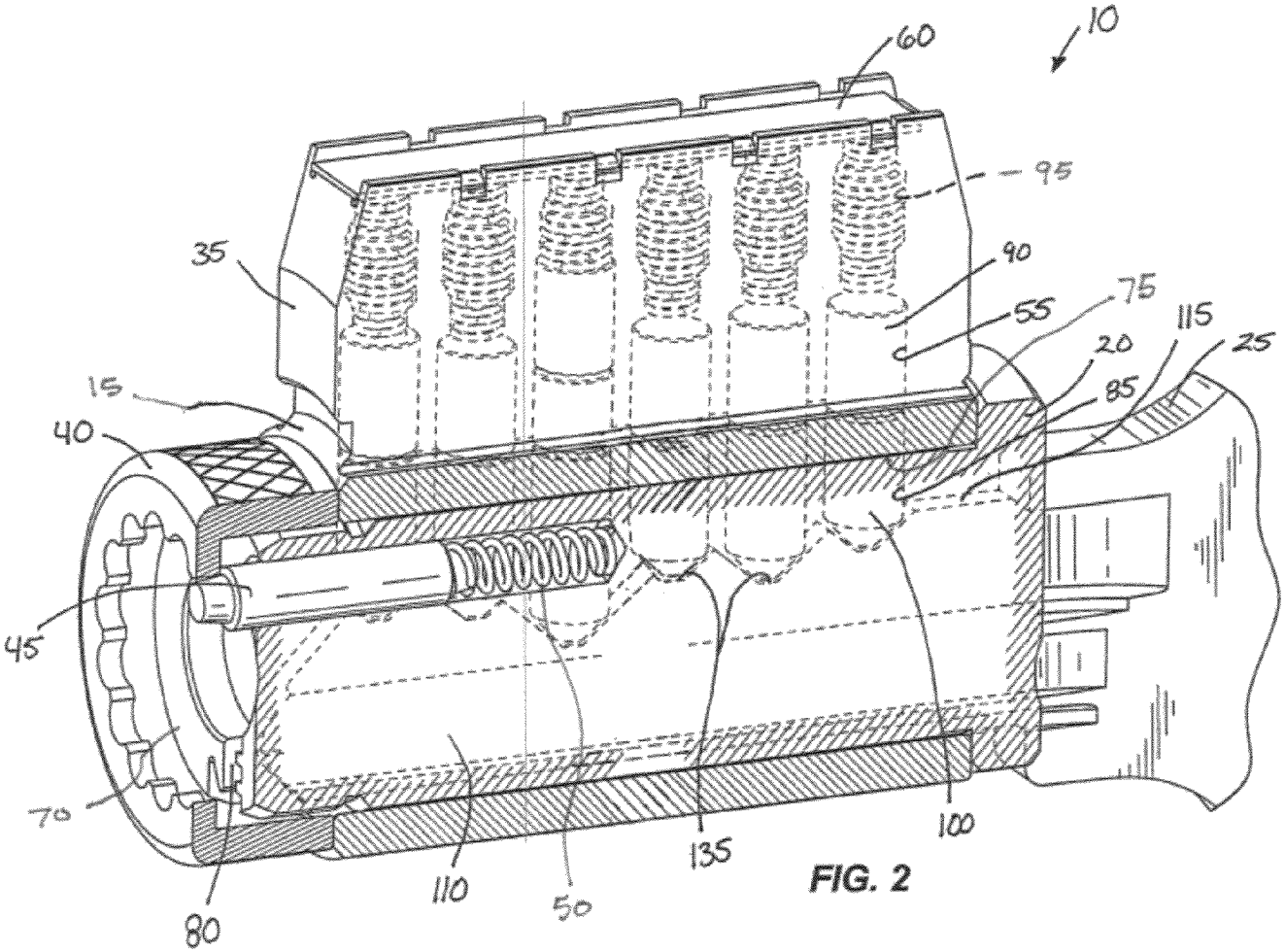
FIG. 2 is a partial cross-section view of the lock cylinder of FIG. 1 including the housing, the plug, and the key.

As shown in FIGS. 1 and 2, the housing 15 includes a wall 30 and a pin portion 35. The wall 30 is substantially cylindrical and defines a hollow portion that is configured to receive the plug 20. The housing 15 is typically fixed relative to the door, and the plug 20 is movable relative to the housing 15 between a locked position and an unlocked position. The plug 20 is typically connected to a driver bar (not shown) or other structure via a retainer or screw cap 40 and an alignment pin 45 biased by a spring 50 (FIG. 2) for moving a latch (not shown) relative to the door to lock or unlock the door. Such arrangements are well known in the art.

The pin portion 35 extends above the wall 30 and includes first or outer pin chambers 55. The outer pin chambers 55 are accessible through a removable member 60 adjacent the outer end of the pin portion 35. In the illustrated construction, the pin portion 35 includes six outer pin chambers 55, but fewer or more outer pin chambers 55 are within the scope of the invention.

FIGS. 1 and 2 show that the plug 20 includes a body rotatable relative to the hollow portion of the housing 15. The body is defined by a first end 65, a second end 70, and an outer surface 75. The first end 65 is accessible from the front of the lock cylinder 10. The second end 70 is accessible from the rear of the lock cylinder 10. The wall 30 and the outer surface 75 of the plug 20 cooperate to define a shear line as is known in the art.

The plug 20 also includes a key passageway 80 and second or inner pin chambers 85. The key passageway 80 extends longitudinally through the body from the first end 65 toward the second end 70, and is further accessible from adjacent the first end 65. The inner pin chambers 85 extend from the outer surface 75 of the plug toward the key passageway 80 substantially transverse to the key passageway 80 such that the inner pin chambers 85 are in communication with the key passageway 80, and are further selectively aligned with respective outer pin chambers 55 upon insertion of the plug 20 into the housing 15.

FIG. 2 shows that the pin portion 35 further includes a respective first or outer pin 90 disposed within each of the outer pin chambers 55. The outer pins 90 are configured to move in a first or inward direction into the plug 20, and in a second or outward direction away from the plug 20. The outer pins 90 extend partially into the respective inner chambers 85 when the plug 20 is in the locked position and a proper key is not inserted into the slot. In the illustrated construction, the pin portion 35 also include springs 95 to bias the outer pins 90 inward. In some constructions, the outer pins 90 can move inward without engagement by springs due to orientation of the pin portion 35 above the plug 20 (i.e., inward movement is assisted by gravity). Inner pins 100 are selectively engaged with the respective outer pins 90. Generally, the quantity of inner pins 100 will be the same as the quantity of outer pins 90, although the quantity of inner pins 100 and the quantity of outer pins 90 can differ.

Figure 3:
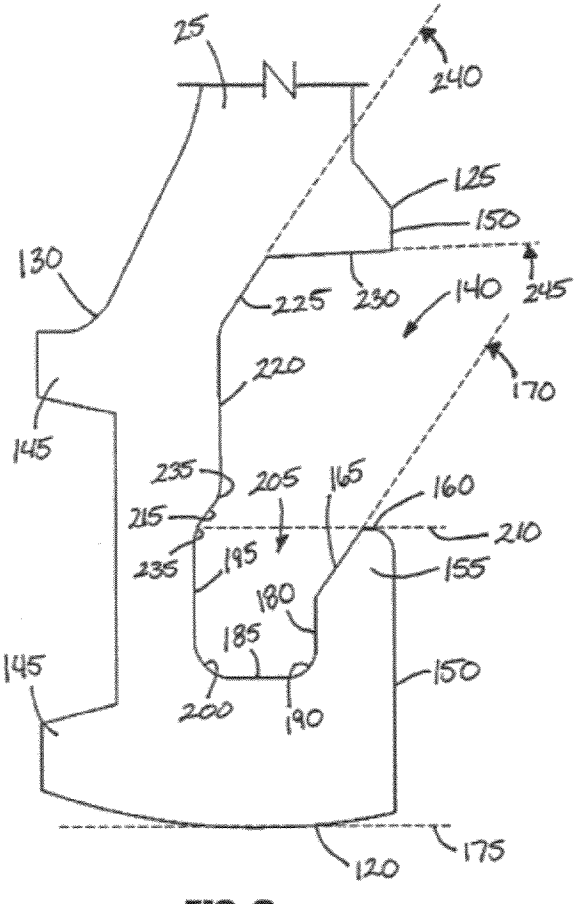
FIG. 3 is a cross-sectional view of the blade of the key of FIG. 1.

FIGS. 1-3 show that the key 25 includes a bow 105 and a blade 110 extending from the bow 105. The bow 105 forms a gripping portion that allows a user to hold and use the key 25. The blade 110 is defined by a first end or top 115 with a pin engagement portion, a second end or bottom 120, a first lateral side 125, and a second lateral side 130 that is opposite the first lateral side 125. Although the key 25 is described in detail with regard to the orientation of FIG. 3, this frame of reference is not limiting. As one of ordinary skill in the art will recognize, the key 25 can be turned or oriented in other directions (e.g., turned 180 degrees such that the top end and the bottom end of the key 25 are reversed). The description below of the key 25 is described with regard to the orientation of the key 25 as illustrated in FIG. 3.

The blade 110 is insertable into the key passageway 80, and extends from and is connected to the bow 105. The key 25 defines a longitudinal axis that extends lengthwise along the blade 110. The blade 110 includes pin engaging portions 135 (FIG. 2) located on the top of the key 25 for engaging the inner pins 100, an undercut groove 140 (FIG. 3) extending longitudinally along the blade 110 on the first lateral side 125, and protrusions or ribs 145 extending longitudinally along the blade 110 on the second lateral side 130. The undercut groove 140 can be formed in the key 25 using a side bit milling process in which the side bit mill is oriented substantially perpendicular to the side of the key 25, or formed using other manufacturing processes.

The first lateral side 125 has an exterior surface 150 that is substantially planar, and the undercut groove 140 is partially defined by an engagement portion or tooth 155 disposed adjacent a lower portion of the first lateral side 125. The tooth 155 is defined by the exterior surface 150, an end or top surface 160 of tooth 155 connected to the exterior surface 150, and a first inner surface 165 extending generally downward and inward from the radial top surface 160. As illustrated, the top surface 160 is an arcuate or radial surface that is engageable with a side pin (not shown) of the plug 20 to move the side pin relative to the plug 20. The first inner surface 165 defines a first angle 170 of approximately 55 degrees relative to a horizontal plane 175, although the first inner surface 165 can be oriented at other angles relative to the horizontal plane 175.

The undercut groove 140 is further partially defined by a second inner surface 180 extending generally downward from the first inner surface 165 of the tooth 155, a bottom surface 185 connected to the second inner surface 180 by a first arcuate transition 190 facing upward, and a third inner surface 195 connected to the bottom surface 185 by a second arcuate transition 200 facing upward. The second inner surface 180, the bottom surface 185, and the third inner surface 195 cooperate to define a generally rectangular undercut channel 205 of the key 25, although other cross-sections are possible and considered herein. As illustrated, the second inner surface 180 is planar and extends substantially vertically downward from the first inner surface 165 to the bottom surface 185, and the third inner surface 195 is planar and extends substantially vertically upward from the bottom surface 185. Also, the upper end of the third inner surface 195 is generally at the same height as the top of the tooth 155, such as at the radial top surface 160, as measured from the horizontal plane 175 (i.e., the upper end of the third inner surface 195 and the top of the tooth 155 are on the same horizontal plane 210). The bottom surface 185 is a planar, substantially horizontal surface that faces upward and is parallel to the horizontal plane 175.

The undercut groove 140 is further partially defined by a fourth inner surface 215 connected to the third inner surface 195, a fifth inner surface 220 connected to the fourth inner surface 215, a sixth inner surface 225 connected to the fifth inner surface 220, and an upper surface 230 connected between the sixth inner surface 225 and the exterior surface 150. The fourth inner surface 215 has arcuate portions 235 connected with each of the third inner surface 195 and the fifth inner surface 220 such that the fourth inner surface 215 is filleted or rounded. In other constructions, the fourth inner surface can be substantially planar and angled by, for example, approximately 55 degrees relative to the horizontal plane 175.

The fifth inner surface 220 is planar and extends substantially vertically upward from the fourth inner surface 215 to the sixth inner surface 225. Stated another way, the fifth inner surface 220 is parallel to and offset from the third inner surface 195 such that the undercut groove 140 adjacent the fifth inner surface 220 is shallower relative to the exterior surface 150 than adjacent the third inner surface 195.

The sixth inner surface 225 extends generally upward and outward from the fifth inner surface 220, and defines a second angle 240 of, for example, approximately 55 degrees relative to the horizontal plane 175. Generally, the sixth inner surface 225 and the first inner surface 165 are parallel to each other. In constructions of the key 25 in which the fourth inner surface 215 is substantially planar, the first, fourth, and sixth inner surfaces 165, 215, 225 are parallel to each other.

With continued reference to FIG. 3, the upper surface 230 is almost horizontal and faces generally downward so that it substantially faces horizontal plane 175 rather than first lateral side 125. As illustrated, the upper surface 230 is a planar surface that defines a third angle 245 of, for example, approximately two degrees relative to the horizontal plane 175. In other constructions, the upper surface 230 can be parallel to the horizontal plane 175, or more substantially angled.

Figure 4:
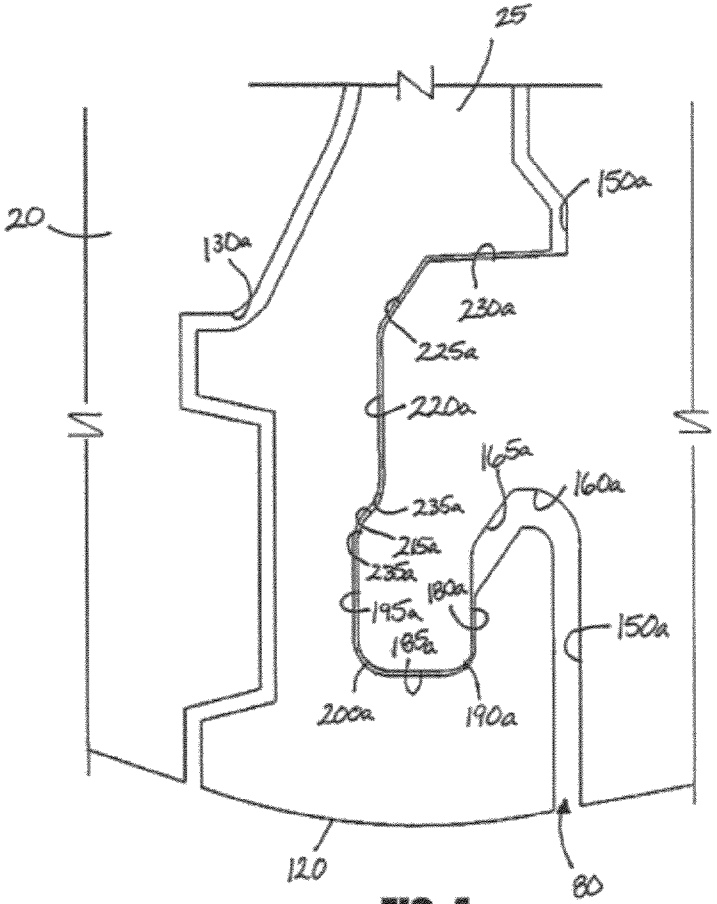
FIG. 4 is the cross-section sectional view of the blade of the key of FIG. 1 positioned in a keyway of the plug of FIG. 1.

FIG. 4 shows the key 25 inserted into the key passageway 80 of the plug 20. Generally, the key passageway 80 is defined by surfaces 130*a*, 150*a*, 160*a*, 165*a*, 180*a*, 185*a*, 190*a*, 195*a*, 200*a*, 215*a*, 220*a*, 225*a*, 230*a*, 235*a* that are complementary to the second lateral side 130, the exterior surface 150, and the interior surfaces 160, 165, 180, 185, 190, 195, 200, 215, 220, 225, 230, 235 defining the undercut groove 140 of the key 25. Stated another way, the second lateral side 130, the exterior surface 150, and the interior surfaces 160, 165, 180, 185, 190, 195, 200, 215, 220, 225, 230 on the key 25 that define the undercut groove 140 correspond to the exterior surfaces 130*a*, 150*a*, 160*a*, 165*a*, 180*a*, 185*a*, 190*a*, 195*a*, 200*a*, 215*a*, 220*a*, 225*a*, 230*a* on the plug 20 that cooperatively define the key passageway 80. As illustrated, the key passageway 80 is sized slightly larger than the key 25 to avoid interference or blocking between the key 25 and the plug 20 during insertion and removal of the key 25 without permitting use of other inappropriate or improper keys to lock or unlock the door.

Figure 6:
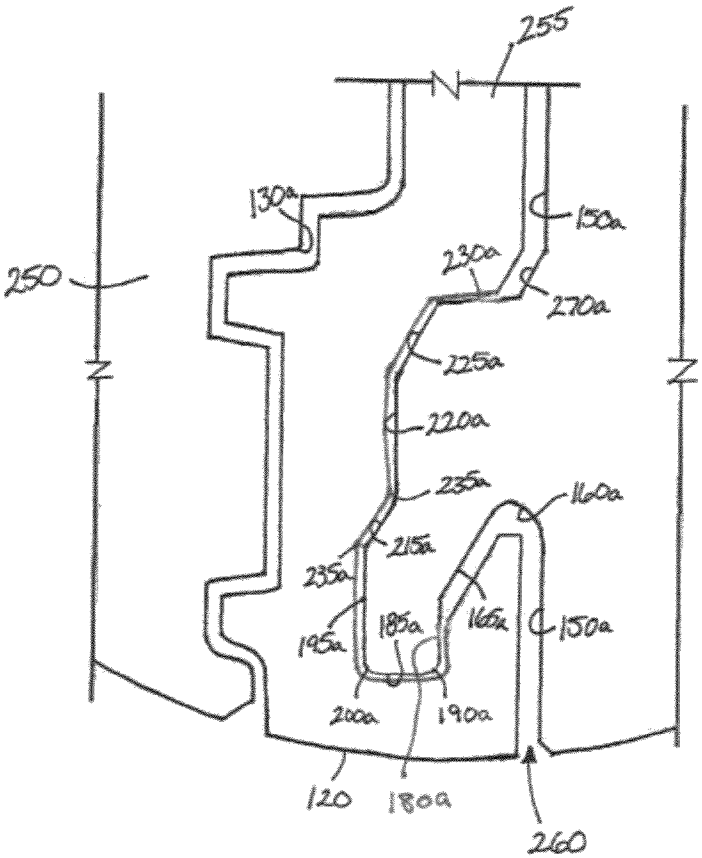
FIG. 6 is the cross-sectional view of the blade of the key of FIG. 5 positioned in the keyway of another embodiment plug.
Figure 5:
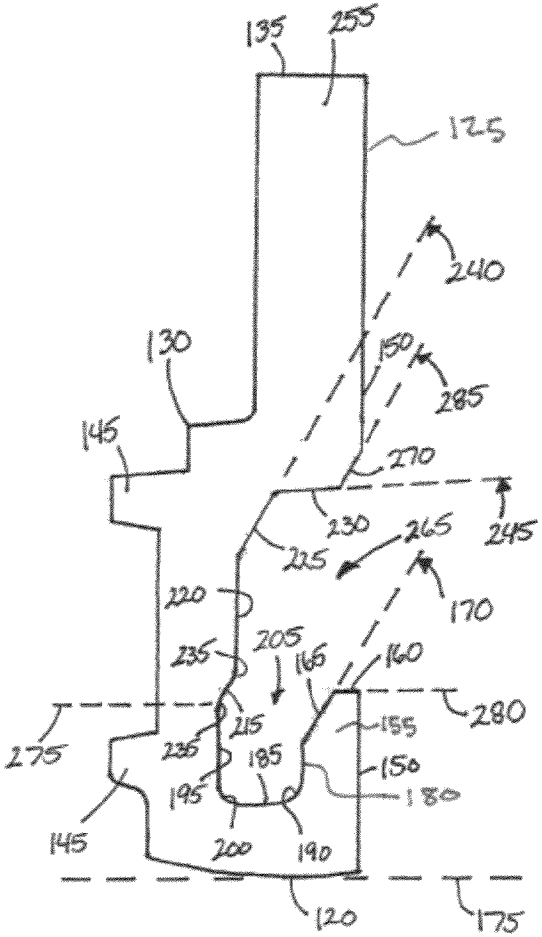
FIG. 5 is a cross-sectional view of the blade of another embodiment key.

Although the invention is described in detail with regard to the lock cylinder 10 and the key 25, other embodiments are also contemplated. For example, FIGS. 5 and 6 show another embodiment plug 250 and another embodiment key 255 for use with the plug 250. Except as described below, the plug 250 and the key 255 are the same as the key in the plug 20 and the key 25 described with regard to FIGS. 1-3, and common elements are given the same reference numerals.

The plug 255 includes a key passageway 260 accessible from the first end 65. FIGS. 5 and 6 show that the blade is defined by the first end or top 115, the second end or bottom 120, the first lateral side 125, and the second lateral side 130. Although the key 255 is described in detail with regard to the orientation of FIG. 5, this frame of reference is not limiting (e.g., the key can be turned 180 degrees such that the top and the bottom of the key are reversed). The description below of the key 255 is described with regard to the orientation of the key 255 in FIG. 5.

The blade 110 includes an undercut groove 265 extending longitudinally along the blade 110 on the first lateral side 125. The undercut groove 265 is partially defined by the tooth 155 disposed adjacent a lower portion of the first lateral side 125. As illustrated, the top surface 160 of the tooth 155 is planar, and the first angle 170 of the first inner surface 165 relative to the horizontal plane 175 is approximately 60 degrees. The top surface is engageable with a side pin (not shown) of the plug 250 to move the side pin relative to the plug 250.

The undercut groove 265 is further partially defined by the second inner surface 180, the bottom surface 185, the third inner surface 195, the fourth inner surface 215, the fifth inner surface 220, the sixth inner surface 225, the upper end surface 230, and a seventh inner surface 270 connected between the upper surface 230 and the exterior surface 150. As illustrated, the upper end of the third inner surface 195 is at a different height relative to the top of the tooth 155, such as at the top surface 160, as measured from the horizontal plane 175 (i.e., the upper end of the third inner surface 195 is on one horizontal plane 275, and the top of the tooth 155 is on a different horizontal plane 280). The fifth inner surface 220 is parallel to and offset from the third inner surface 195 such that the undercut groove 265 adjacent the fifth inner surface 220 is shallower relative to the exterior surface 150 than adjacent the third inner surface 195. As illustrated, the second angle of the sixth inner surface 225 is approximately 60 degrees relative to the horizontal plane.

The seventh inner surface 270 extends generally upward and outward from the upper surface, and defines a fourth angle 285 of, for example, approximately 60 degrees relative to the horizontal plane 175. Generally, the first inner surface 165, the sixth inner surface 225, and the seventh inner surface 270 are parallel to each other, although two or more of the surfaces 165, 225, 270 can be nonparallel relative to each other. The undercut groove 265 is similar in shape to the undercut groove 140 described with regard to FIGS. 3 and 4, although the dimensions such as the lengths of the interior surfaces, the angles between adjacent inter surfaces, contours, and other such specific features of the undercut groove 265 can generally differ from like corresponding features of the undercut groove 140.

FIG. 6 shows the key 255 inserted into the key passageway 260 of the plug 250. Generally, the key passageway 260 is defined by surfaces 130*a*, 150*a*, 160*a*, 165*a*, 180*a*, 185*a*, 190*a*, 195*a*, 200*a*, 215*a*, 220*a*, 225*a*, 230*a*, 235*a*, 270*a* that are complementary to the second lateral side 130, the exterior surface 150, and the interior surfaces 160, 165, 180, 185, 190, 195, 200, 215, 220, 225, 230, 235, 270 defining the undercut groove 265 of the key 255. Stated another way, the second lateral side 130, the exterior surface 150, and the interior surfaces 160, 165, 180, 185, 190, 195, 200, 215, 220, 225, 230, 270 on the key 255 that define the undercut groove 265 correspond to exterior surfaces 130*a*, 150*a*, 160*a*, 165*a*, 180*a*, 185*a*, 190*a*, 195*a*, 200*a*, 215*a*, 220*a*, 225*a*, 230*a*, 270*a* on the plug 250 that cooperatively define the key passageway 260. As illustrated, the key passageway 260 is sized slightly larger than the key 255 to avoid interference between the plug 250 and the key 255 during insertion and removal of the key 255 without permitting use of other inappropriate or improper keys to lock or unlock the door.

Figure 8:
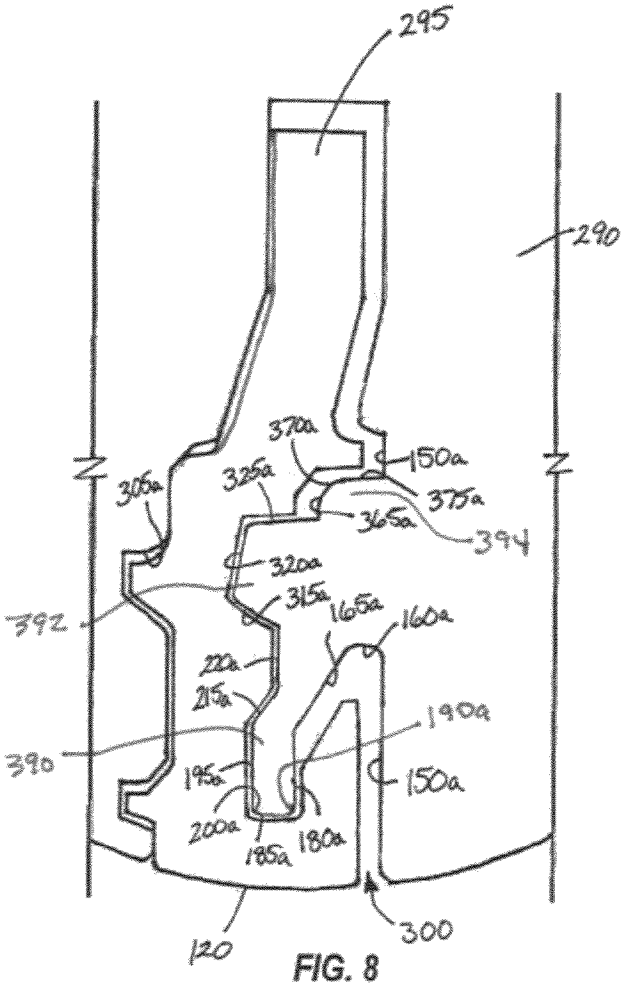
FIG. 8 is the cross-sectional view of the blade of the key of FIG. 7 positioned in the keyway of another embodiment plug.
Figure 7:
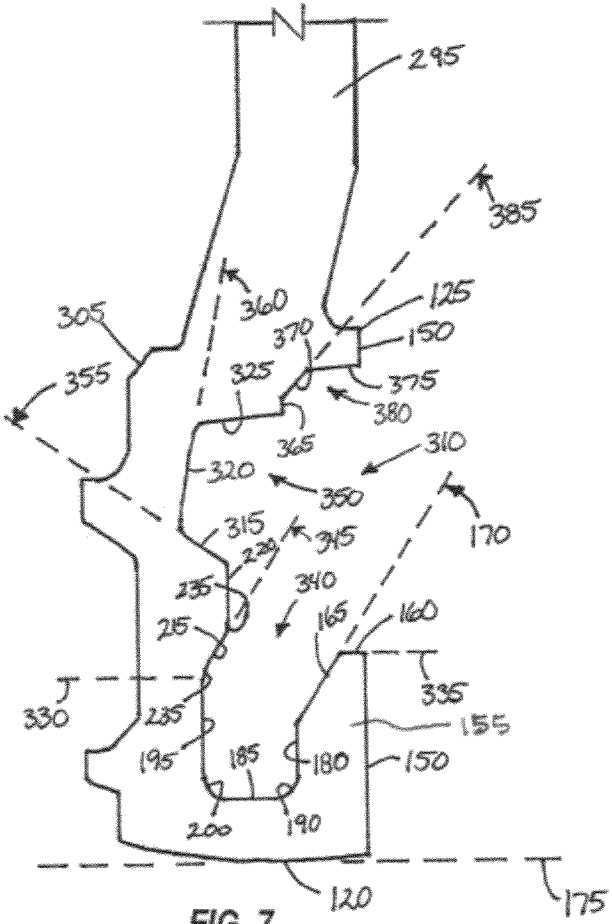
FIG. 7 is a cross-sectional view of the blade of another embodiment key.

FIGS. 7 and 8 show another plug 290 and a key 295 for use with the plug 290, which is similar to the plug 20 described with regard to FIGS. 1 and 2. Except as described below, the plug 290 and the key 295 are the same as the plug 20 and the key 25 described with regard to FIGS. 1-3, and common elements are given the same reference numerals.

The plug 290 includes a key passageway 300 accessible from the first end 65, the blade 110 is defined by the first end or top 115, the second end or bottom 120, the first lateral side 125, and a second lateral side 305. Although the key 295 is described in detail with regard to the orientation of FIG. 7, this frame of reference is not limiting. For example, the key 295 can be turned 180 degrees such that the top and the bottom of the key 295 are reversed. The description below of the key 295 is described with regard to the orientation of the key 295 in FIG. 7.

Referring to FIG. 7, the blade 110 includes an undercut groove 310 extending longitudinally along the blade 110 on the first lateral side 125. The undercut groove 310 is partially defined by the tooth 155 disposed adjacent a lower portion of the first lateral side 125. As illustrated, the top surface 160 of the tooth 155 is planar, and the first angle 170 of the first inner surface 165 relative to the horizontal plane 175 is, for example, approximately 60 degrees. The top surface 160 is engageable with a side pin (not shown) of the plug 290 to move the side pin relative to the plug 290.

The undercut groove 310 is further partially defined by the second inner surface 180, the bottom surface 185, the third inner surface 195, the fourth inner surface 215, the fifth inner surface 220, a sixth inner surface 315, a seventh inner surface 320, and an eighth inner surface 325. The upper end of the third inner surface 195 is at a different height relative to the top of the tooth 155, such as the top surface 160, as measured from the horizontal plane 175 (for example, the upper end of the third inner surface 195 is on one horizontal plane 330, and the top of the tooth 155 is on a different horizontal plane 335). The second inner surface 180, the bottom surface 185, and the third inner surface 195 cooperate to define a first undercut channel 340 of the key 295. The first undercut channel 340 has a rectangular cross-section similar to the undercut channel 205, although other cross-sections are possible and considered herein. With reference to FIG. 7, the first undercut channel 340 extends generally downward into the key 295.

The fifth inner surface 220 is parallel to and offset from the third inner surface 195 such that the undercut groove 310 adjacent the fifth inner surface 220 is shallower relative to the exterior surface 150 than adjacent the third inner surface 195. As illustrated, the fourth inner surface 215 is substantially planar and oriented at a second angle 345 of, for example, approximately 60 degrees, relative to the horizontal plane 175.

The sixth inner surface 315, the seventh inner surface 320, and the eighth inner surface 325 cooperate to define a second undercut channel 350 of the key 295. The second undercut channel 350 has a non-uniform cross-section, although other cross-sections are possible and considered herein. The first undercut channel 340 extends generally upward into the key 295.

The sixth inner surface 315 extends generally upward and inward from the fifth inner surface 220 toward second lateral surface 305. The sixth inner surface 315 is planar and defines a third angle 355 of, for example, approximately 150 degrees relative to the horizontal plane 175. In some constructions, the sixth inner surface 315 is perpendicular to the first inner surface 165.

The seventh inner surface 320 extends generally upward and outward from the sixth inner surface 315. The seventh inner surface 320 is planar defines a fourth angle 360 of, for example, approximately 80 degrees relative to the horizontal plane 175. The eighth inner surface 325 extends upward and outward from the seventh inner surface 320. The eighth inner surface 325 is slightly inclined so that it is nearly horizontal and faces generally downward.

The undercut groove 310 is further partially defined by a ninth inner surface 365 extending upward from the eighth inner surface 325, a tenth inner surface 370 extending upward and outward from the ninth inner surface 365, and an upper surface 375 extending upward and outward from the tenth inner surface 370. The ninth inner surface 365, the tenth inner surface 370, and the upper surface 375 cooperate to define a third undercut channel 380 of the key 295. The third undercut channel 380 has a non-uniform cross-section, and extends generally upward into the key 295. As shown in FIG. 7, the third undercut channel 380 is formed adjacent the second undercut channel 350 and is generally smaller than the second undercut channel 350.

The ninth inner surface 365 is a vertically-oriented surface. The tenth inner surface 370 defines a fifth angle 385 (e.g., approximately 60 degrees) relative to the horizontal plane 175. Generally, the first inner surface 165, the fourth inner surface 215, and the tenth inner surface 370 are parallel to each other.

The upper surface 375 is almost horizontal and faces generally downward, and is substantially parallel to the eighth inner surface 325. In other constructions, the upper surface 375 can be non-parallel relative to the eighth inner surface 325.

FIG. 8 shows the key 295 inserted into the key passageway 300 of the plug 290. Generally, the key passageway 300 is defined by surfaces 305*a*, 150*a*, 160*a*, 165*a*, 180*a*, 185*a*, 190*a*, 195*a*, 200*a*, 215*a*, 220*a*, 315*a*, 320*a*, 325*a*, 365*a*, 370*a*, 375*a* that are complementary to the second lateral side 305 and the surfaces 150, 160, 165, 180, 185, 190, 195, 200, 215, 220, 315, 320, 325, 365, 370, 375 defining the undercut groove 310 of the key 295. Stated another way, the exterior surface 150, the second lateral side 305, and the interior surfaces 160, 165, 180, 185, 190, 195, 200, 215, 220, 315, 320, 325, 365, 370, 375 on the key 295 that define the undercut groove 310 correspond to exterior surfaces 150*a*, 305*a*, 160*a*, 165*a*, 180*a*, 185*a*, 190*a*, 195*a*, 200*a*, 215*a*, 220*a*, 315*a*, 320*a*, 325*a*, 365*a*, 370*a*, 375*a*, respectively, on the plug 290 that cooperatively define the key passageway 300. As illustrated, the key passageway 300 is sized slightly larger than the key 295 to avoid substantial interference between the plug 290 and the key 295 during insertion and removal of the key 295 without permitting use of other inappropriate or improper keys to lock or unlock the door.

Although assembly of the invention is described in detail below with regard to the lock cylinder 10, one of ordinary skill in the art will recognize that other lock cylinders including the plugs 250, 290 are assembled in the same or a similar manner.

The lock cylinder 10 is assembled by inserting the inner pins 100 into the inner pin chambers 85 from adjacent a top of the plug 20. The plug 20 is then inserted into the housing 15 after the inner pins 100 have been positioned in the plug 20. The outer pins 90 are positioned in the outer pin chambers 55 after the plug 20 has been assembled and inserted into the housing 15. The springs 95 are inserted into the pin portion 35 after insertion of the outer pins 90 to bias the outer pins 90 and the inner pins 100 inward such that the outer pins 90 partially extend into the inner pin chambers 85. Assembly of the remaining components of the lock cylinder 10 is well known to those skilled in the art.

As illustrated in FIGS. 4, 6, and 8, several surfaces on the plugs 20, 250, 290 cooperate to define one or more protrusions or projections that are engaged by the corresponding key 25, 255, 295 within the respective undercut groove 140, 265, 310. For example, with reference to FIGS. 7 and 8, the key passageway 300 has three of these projections 390, 392, 394, each of which is engaged by the key 295 within the respective undercut channels 340, 350, 380. The complementary shapes of each undercut groove 140, 265, 310 and the projections on the corresponding key passageway 80, 260, 300 permit locking and unlocking of the door using the appropriate key 25, 255, 295 while other inappropriate keys with non-conforming cross-sections cannot be used to lock and unlock the door (i.e., the inappropriate keys are blocked) by the one or more projections formed by plugs 20, 240, 290.

The unique key cross-sections disclosed herein provide an undercut groove in a lateral side of the blade of the key where the groove has a substantial cross-sectional area and configuration that is particularly effective in preventing cross-keying. In particular, the key passageways formed to accept the key cross-sections disclosed herein have substantial lug or blocking areas that provide more effective blocking of an incorrect key into the passageway. Furthermore, while the unique key passageways disclosed herein only accept insertion of keys having the corresponding cross-sections disclosed herein, keys having the cross-sections disclosed herein with substantial undercut grooves are more readily backwards compatible with key passageways of similar configurations but with smaller lug or projection areas in the passageway.

In one aspect, there is disclosed a key for a lock cylinder. The key comprises a bow and a blade extending from and connected to the bow. The blade is defined by a first lateral side and a second lateral side opposite the first lateral side, the first lateral side having an undercut groove partially defined by parallel, offset surfaces and an engagement portion for engaging a pin of the lock cylinder.

In another aspect, a key for a lock cylinder is disclosed. The key comprises a bow and a blade extending from and connected to the bow. The blade is defined by a first lateral side and a second lateral side opposite the first lateral side, the first lateral side having an undercut groove defined by a first undercut channel oriented generally downward in the key and a second undercut channel oriented generally upward in the key.

In a further aspect, a key and lock cylinder combination is disclosed. The combination includes a key including a bow and a blade extending from and connected to the bow. The blade is defined by a first lateral side and a second lateral side opposite the first lateral side, the first lateral side having an undercut groove defined by a plurality of surfaces, at least two of the surfaces parallel to and offset from each other. The combination also includes a lock cylinder including a housing and a plug rotatable relative to the housing, the plug having a key passageway defined by a plurality of surfaces complementary to the plurality of surfaces defining the undercut groove.

In yet a further aspect, a key and lock cylinder combination is disclosed. The combination includes a key including a bow and a blade extending from and connected to the bow, the blade defined by a first lateral side and a second lateral side opposite the first lateral side, the first lateral side having an undercut groove defined by a first undercut channel oriented generally downward in the key, a second undercut channel oriented generally upward in the key, and a third undercut channel oriented generally upward in the key. The combination also includes a lock cylinder including a housing and a plug rotatable relative to the housing, the plug having a key passageway defined by a first projection engageable by the key within the first undercut channel, a second projection engageable by the key within the second undercut channel, and a third projection engageable by the key within the third undercut channel.

According to another aspect, a key for a lock cylinder is disclosed. The key comprises a bow and a blade extending from and connected to the bow. The blade is defined by a first lateral side and a second lateral side opposite the first lateral side, one end extending between the first and second lateral sides along the blade, and an engagement portion opposite the end that extends along the blade for engaging at least one pin of the lock cylinder. The first lateral side of the blade has an undercut groove at least partially defined by facing parallel first and second surfaces and a third surface that is offset from and parallel to each of the first and second surfaces. The groove is further at least partially defined by an end surface that substantially faces a horizontal plane that includes at least a portion of the end of the blade therein and a fourth surface extending between the third surface and the end surface of the groove. The fourth surface is obliquely oriented to the horizontal plane.

According to another aspect, a key for a lock cylinder is disclosed. The key comprises a bow and a blade extending from and connected to the bow. The blade is defined by a first lateral side and a second lateral side opposite the first lateral side. The first lateral side has an undercut groove defined by a first undercut channel oriented generally in a first direction in the key and a second undercut channel oriented generally in a second direction in the key opposite the first direction. The first and second undercut channels are at least partially defined by respective ones of first and second inner surfaces facing the first lateral side and the first and second inner surfaces are separated by a third inner surface that is offset from the first and second inner surfaces toward the first lateral side.

According to another aspect, a key and lock cylinder combination is disclosed. The combination includes a key including a bow and a blade extending from and connected to the bow. The blade is defined by a first lateral side and a second lateral side opposite the first lateral side. The blade further includes an engagement portion extending therealong between the first and second lateral sides and an end opposite the engagement portion. The first lateral side has an undercut groove defined by a plurality of surfaces. At least two of the plurality of surfaces are parallel to and face one another. The plurality of surfaces further include a third surface in the groove that is parallel to and offset from each of two facing surfaces. The plurality of surfaces of the undercut groove further include an end surface that substantially faces a horizontal plane including at least a portion of the end of the blade therein, and the plurality of surfaces include a fourth surface extending between the third surface and the upper surface that is obliquely oriented to the horizontal plane. The combination further includes a lock cylinder including a housing and a plug rotatable relative to the housing. The plug has a key passageway defined by a plurality of surfaces complementary to the plurality of surfaces defining the undercut groove.

According to a further aspect, a key and lock cylinder combination is disclosed. The combination includes a key including a bow and a blade extending from and connected to the bow. The blade is defined by a first lateral side and a second lateral side opposite the first lateral side. The first lateral side has an undercut groove defined by a first undercut channel oriented generally in a first direction in the key and a second undercut channel oriented generally in a second direction in the key opposite the first direction. The first and second undercut channels are at least partially defined by respective ones of first and second inner surfaces facing the first lateral side. The first and second inner surfaces are separated by a third inner surface that is offset from the first and second inner surfaces toward the first lateral side. The combination further includes a lock cylinder including a housing and a plug rotatable relative to the housing. The plug has a key passageway defined by a first projection receivable by the key within the first undercut channel, a second projection receivable by the key within the second undercut channel, and a recess between the first and second projections that receives the third inner surface.

Although the invention is described in detail with regard to the lock cylinder 10, one of ordinary skill in the art will recognize that other lock cylinders (e.g., interchangeable core cylinders, mortise lock cylinders, etc.) are within the scope of the invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A key for a lock cylinder, the key comprising:

a bow; and a blade extending from and connected to the bow, the blade defined by a first lateral side and a second lateral side opposite the first lateral side, one end extending between the first and second lateral sides along the blade, and an engagement portion opposite the end that extends along the blade for engaging at least one pin of the lock cylinder, the first lateral side of the blade having an undercut groove at least partially defined by facing parallel first and second surfaces and a third surface that is offset from and parallel to each of the first and second surfaces, wherein the first surface is positioned on a tooth that extends on the first lateral side from the end of the blade toward the engagement portion, the tooth including an outer end surface opposite the end of the blade extending to the first lateral side, and wherein the undercut groove is further at least partially defined by an end surface substantially facing a horizontal plane including at least a portion of the end of the blade therein, and the undercut groove is at least partially defined by a fourth surface extending between the third surface and the end surface of the undercut groove, a fifth surface extending between the end surface of the tooth and the first surface, and a sixth surface extending between the second surface and the third surface, wherein the fourth, fifth, and sixth surfaces are substantially parallel to one another and are obliquely oriented relative to the horizontal plane.

2. The key of claim 1, wherein the undercut groove defines an undercut channel defined by the first and second surfaces and an end surface of the channel extending between the first and second surfaces.

3. The key of claim 2, wherein the end surface of the undercut channel is connected to the first and second surfaces by respective ones of first and second arcuate transitions.

4. The key of claim 1, wherein:

the end surface of the undercut groove extends to the first lateral side; and the undercut groove defines an opening at the first lateral side between intersections of the end surface of the tooth and the end surface of the undercut groove with the first lateral side.

5. The key of claim 4, wherein the end surface of the tooth and an end of the first surface opposite the end of the blade are located in a plane that is parallel to the horizontal plane.

6. The key of claim 4, wherein the end surface of the tooth is arcuate.

7. The key of claim 4, wherein the end surface of the tooth is planar.

8. The key of claim 1, wherein the sixth surface is connected to the second surface and the third surface by first and second arcuate portions, respectively.

9. The key of claim 1, wherein the fifth and sixth surfaces are parallel to the fourth surface.

10. The key of claim 9, wherein fourth, fifth and sixth surfaces each form an angle ranging from about 55 degrees to about 60 degrees with the horizontal plane.

11. The key of claim 1, wherein the end surface of the undercut groove is obliquely oriented to the horizontal plane.

12. The key of claim 11, wherein end surface of the undercut groove forms an angle of about 2 degrees with the horizontal plane.

13. The key of claim 1, wherein the blade includes a pair of protrusions extending from the second lateral side thereof, the pair of protrusions spaced from one another along a height of the blade.

14. The key of claim 1, wherein the tooth includes an outer end surface opposite the end of the blade, and the undercut groove is further defined by a fifth surface extending between the end surface of the tooth and the first surface, a sixth surface extending between the second surface and the third surface, and a seventh surface extending between the end surface of the undercut groove and the first lateral side, wherein the fifth, sixth and seventh surfaces are parallel to one another and obliquely oriented to the horizontal plane.

15. The key of claim 14, wherein fifth, sixth and seventh surfaces are parallel to the fourth surface.

16. The key of claim 15, wherein fourth, fifth, sixth and seventh surfaces each form an angle ranging from about 55 degrees to about 60 degrees with the horizontal plane.

17. A key for a lock cylinder, the key comprising:

a bow; and a blade extending from and connected to the bow, the blade defined by a first lateral side and a second lateral side opposite the first lateral side, the first lateral side having an undercut groove defined by a first undercut channel oriented generally in a first direction in the key and a second undercut channel oriented generally in a second direction in the key perpendicular to the first direction, wherein the first and second undercut channels are at least partially defined by respective ones of first and second inner surfaces facing the first lateral side, the first and second inner surfaces separated by a third inner surface that is offset from the first and second inner surfaces toward the first lateral side, and the second undercut channel is further defined by an inner end surface extending from the second inner surface toward the first lateral side, and wherein the undercut groove is further defined by a third undercut channel between the inner end surface and the first lateral surface.

18. The key of claim 17, wherein the blade is further defined by an end that extends between the first and second lateral sides along the blade and an engagement portion opposite the end that extends along the blade for engaging at least one pin of the lock cylinder.

19. The key of claim 18, wherein the first undercut channel defines a tooth extending from the end of the blade toward the engagement portion.

20. The key of claim 19, wherein the first undercut channel is further defined by a fourth inner surface along the tooth that faces and is parallel to the first inner surface.

21. The key of claim 20, wherein the first undercut channel includes a bottom surface extending between the first and fourth surfaces.

22. The key of claim 21, wherein the bottom surface is connected to the first and fourth surfaces by respective ones of first and second arcuate transitions.

23. The key of claim 20, wherein:

the tooth includes an outer end surface extending to the first lateral side;

the first undercut channel is further defined by a fifth inner surface that extends between the end surface of the tooth and the fourth inner surface;

the first undercut channel is further defined by a sixth inner surface that extends between the first inner surface and the third inner surface; and the second undercut channel is further defined by a seventh inner surface that extends between the third inner surface and the second inner surface.

24. The key of claim 23, wherein the fifth inner surface and the sixth inner surface are parallel to one another and obliquely oriented to a horizontal plane that includes the end of the blade.

25. The key of claim 24, wherein the seventh inner surface is perpendicular to the fifth inner surface.

26. The key of claim 25, wherein second inner surface forms an angle of about 80 degrees with the horizontal plane.

27. The key of claim 17, wherein the third undercut channel is defined by an eighth inner surface extending from the inner end surface to a ninth inner surface, and the ninth inner surface is parallel to at least one of the fifth and sixth inner surfaces.

28. The key of claim 27, wherein the third undercut channel is further defined by an end surface facing the end of the blade, the end surface extending from the ninth inner surface to the first lateral surface.

29. The key of claim 28, wherein the undercut groove includes an opening into the first lateral side defined by the intersection of the outer end surface of the tooth with the first lateral side and the intersection of the end surface of the third undercut channel with the first lateral side.

30. The key of claim 17, wherein the blade is further defined by an end that extends between the first and second lateral sides along the blade, the first undercut channel defines a tooth extending on the first lateral side from the end of the blade, and the undercut groove further comprises a third undercut channel extending from the first lateral side to the second undercut channel so that the second undercut channel is located between the first and third undercut channels.

31. A key and lock cylinder combination comprising:

a key including a bow and a blade extending from and connected to the bow, the blade defined by a first lateral side and a second lateral side opposite the first lateral side, the blade further including an engagement portion extending therealong between the first and second lateral sides and an end opposite the engagement portion, the first lateral side having an undercut groove defined by a plurality of surfaces, at least two of the plurality of surfaces being parallel to and facing one another, the plurality of surfaces further including a third surface in the undercut groove that is parallel to and offset from each of the two facing surfaces, wherein the first facing surface is positioned on a tooth that extends on the first lateral side from the end of the blade toward the engagement portion, the tooth including an outer end surface opposite the end of the blade extending to the first lateral side, and wherein the plurality of surfaces of the undercut groove further include an end surface that substantially faces a horizontal plane including at least a portion of the end of the blade therein, and the undercut groove is at least partially defined by a fourth surface extending between the third surface and the end surface, a fifth surface extending between the end surface of the tooth and the first facing surface, and a sixth surface extending between the second facing surface and the third surface, wherein the fourth, fifth, and sixth surfaces are substantially parallel to one another and are obliquely oriented relative to the horizontal plane; and a lock cylinder including a housing and a plug rotatable relative to the housing, the plug having a key passageway defined by a plurality of surfaces complementary to the plurality of surfaces defining the undercut groove.

32. The combination of claim 31, wherein the second facing surface includes an end opposite the end of the blade, wherein the end surface of the tooth and the end of the other of the two facing surfaces define a plane that is parallel to the horizontal plane.

33. The combination of claim 31, wherein the end surface of the undercut groove extends to the first lateral surface in substantially parallel relation to the horizontal plane.

34. A key and lock cylinder combination comprising:

a key including a bow and a blade extending from and connected to the bow, the blade defined by a first lateral side and a second lateral side opposite the first lateral side, the first lateral side having an undercut groove defined by a first undercut channel oriented generally in a first direction in the key and a second undercut channel oriented generally in a second direction in the key perpendicular to the first direction, wherein the first and second undercut channels are at least partially defined by respective ones of first and second inner surfaces facing the first lateral side, the first and second inner surfaces separated by a third inner surface that is offset from the first and second inner surfaces toward the first lateral side, and the second undercut channel is further defined by an inner end surface extending from the second inner surface toward the first lateral side, and wherein the undercut groove is further defined by a third undercut channel between the inner end surface and the first lateral surface such that the second undercut channel is located between the first and third undercut channels; and a lock cylinder including a housing and a plug rotatable relative to the housing, the plug having a key passageway defined by a first projection receivable by the key within the first undercut channel, a second projection receivable by the key within the second undercut channel, and a recess between the first and second projections that receives the third inner surface.

35. The combination of claim 34, wherein:

the blade is further defined by an end that extends between the first and second lateral sides along the blade, the first undercut channel defines a tooth extending along the first lateral side from the end of the blade; and the key passageway is defined by a third projection that is receivable in the third undercut channel.

* * * * *